US005226745A

United States Patent [19]

Gartlacher

[11] Patent Number: 5,226,745

[45] Date of Patent: Jul. 13, 1993

[54] PAVEMENT MARKER

[76] Inventor: John Gartlacher, 28-32 Victoria Street, Riverstone, New South Wales 2765, Australia

[21] Appl. No.: 764,884

[22] Filed: Sep. 24, 1991

[51] Int. Cl.[5] ..... G08B 00/00

[52] U.S. Cl. ..... 404/14; 404/16

[58] Field of Search ..... 404/9-11, 404/12-16; 362/153.1

[56] References Cited

U.S. PATENT DOCUMENTS

| | | | |
|---|---|---|---|
| 3,784,279 | 1/1974 | Hedgewick | 404/12 X |
| 3,971,623 | 7/1976 | Hedgewick et al. | 404/12 X |
| 3,980,393 | 9/1976 | Heasley et al. | 404/12 X |
| 4,129,397 | 12/1978 | Eigenmann | 404/14 |
| 4,208,090 | 6/1980 | Keenan | 404/14 X |
| 4,875,789 | 10/1989 | May | 404/12 |
| 5,002,424 | 3/1991 | Hedgewick | 404/13 X |

FOREIGN PATENT DOCUMENTS

| | | | |
|---|---|---|---|
| 372333 | 6/1990 | European Pat. Off. | 404/13 |

*Primary Examiner*—Ramon S. Britts
*Assistant Examiner*—Nancy P. Connolly
*Attorney, Agent, or Firm*—Edwin D. Schindler

[57] ABSTRACT

A pavement marker including a body (1), at least one hermetic chamber (14) in the body, a reflector panel (6,7) positioned in the side of the body (1) for each chamber and sufficiently transparent to allow the passage of light therethrough and form a window in the body (1) into the hermetic chamber (14), a substantially smooth external face on the reflector panel (6,7) which lies at an acute angle to a base surface of the body (1) and reflective prismatic projections (8) on an inner face of said reflector panel (6,7) with the projections spaced from a back face (11) of said chamber (14).

8 Claims, 2 Drawing Sheets

PAVEMENT MARKER

This invention relates to pavement markers of the type which are used to delineate vehicle lanes on pavements. Markers for this purpose include as an essential feature light reflective means whereby the light from the headlights of a vehicle approaching the marker is trapped and reflected back at the vehicle.

Many forms of pavement markers have been developed over the years and each newly developed form has had its characterising features. This invention has been devised to provide a marker with features which overcome disadvantages which the inventor has observed in markers as provided hitherto.

One of the features which distinguish the pavement marker of this invention from known markers is the shape of the body of the marker which has been developed to facilitate the smooth passage of vehicle wheels over the marker. Another is the use of an uncoated prismatic reflective surface, in known markers the reflective surface is provided with a coating of reflective material applied in vacuum metalising process. Another feature is the provision of gas filled chambers in the marker behind the reflective surface(s) thereof.

Broadly stated, the invention in its preferred form provides a pavement marker including a body, at least one hermetic chamber in the body, a reflector panel in a side of the body sufficiently transparent to allow the passage of light therethrough to form a window in the body into the hermetic chamber, a substantially smooth external face on the reflector panel which lies at an acute angle to a base surface of the body and reflective prismatic projections on an inner face of said reflector panel with the projections spaced from a back face of said chamber.

A presently preferred embodiment of the invention will now be described with reference to the accompanying drawings in which.

Figure 1:
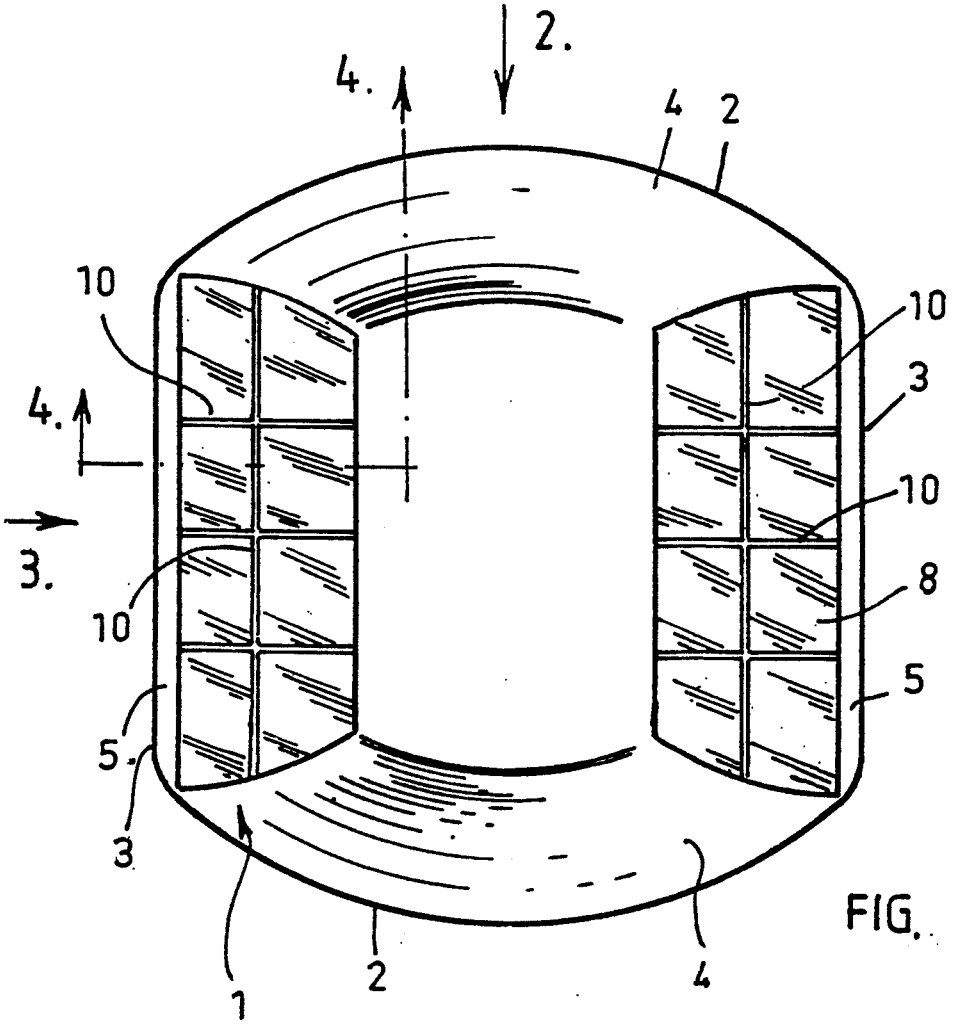
FIG. 1 is a plan view of the marker according to the invention.
Figure 2:
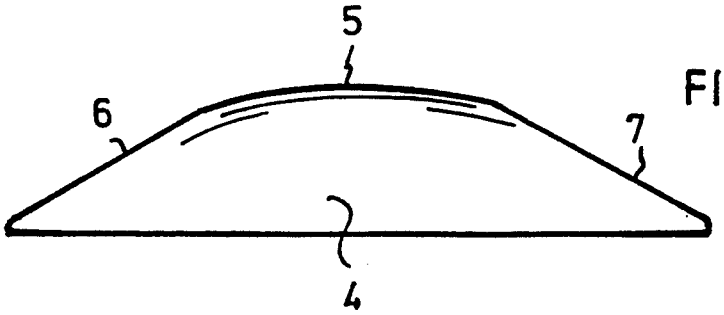
FIG. 2 is an edge view in the direction of the arrow 2.
Figure 3:
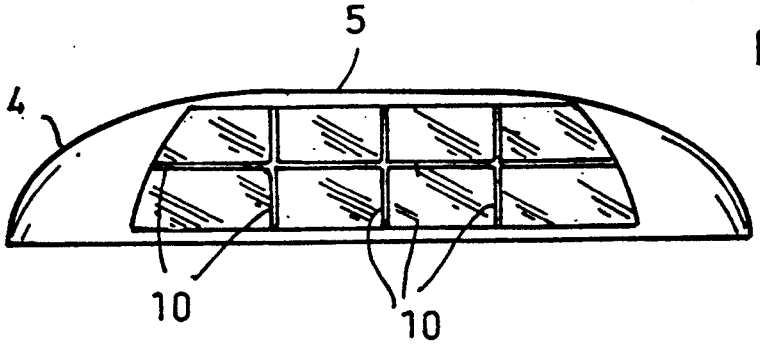
FIG. 3 is an edge view in the direction of the arrow 3.

In the preferred embodiment the marker comprises a hollow saucer-like body shell 1 which when viewed in plan from above, see FIG. 1, is somewhat circular with the perimeter made up of opposed curved parts 2 and opposed straight parts 3. The curved zones 2 are preferably arcs of the circumference of one circle. From FIG. 2 it will be seen that the body shell 1 has two flat opposed side faces 6 and 7 which lie at acute angles to the base surface of the body shell and extend from the perimeter parts 3 upwardly towards the curved crown 5 of the body. From FIG. 3 it will be seen that the marker body has opposed curved side faces which extend between the crown 5 of the body shell 1 and the other perimeter parts 2.

The preferred manner of manufacture for the body shell 1 is a moulding process using a plastics material which is sufficiently transparent to allow the passage of light therethrough and which is able to withstand abrasion and shock loads. An example of a suitable plastics material would be methyl methacrylate (acrylic) but the invention is not limited to the use of that material.

The walls of the body shell 1 are of the same general thickness throughout with the exception of the areas behind the faces 6 and 7 where the shell wall is thinner to provide reflector panels and windows into the interior of the body shell 1. The faces 6 and 7 are substantially smooth external surfaces for the reflector panels and on the inner faces of the reflector panels there is a multitude of light reflective prisms 8, which are known in the trade as corner cube reflectors. The prisms are formed in the moulding step which produces the shell. In this way a single simple moulding operation provides the body shell and the entire reflective means.

Figure 4:
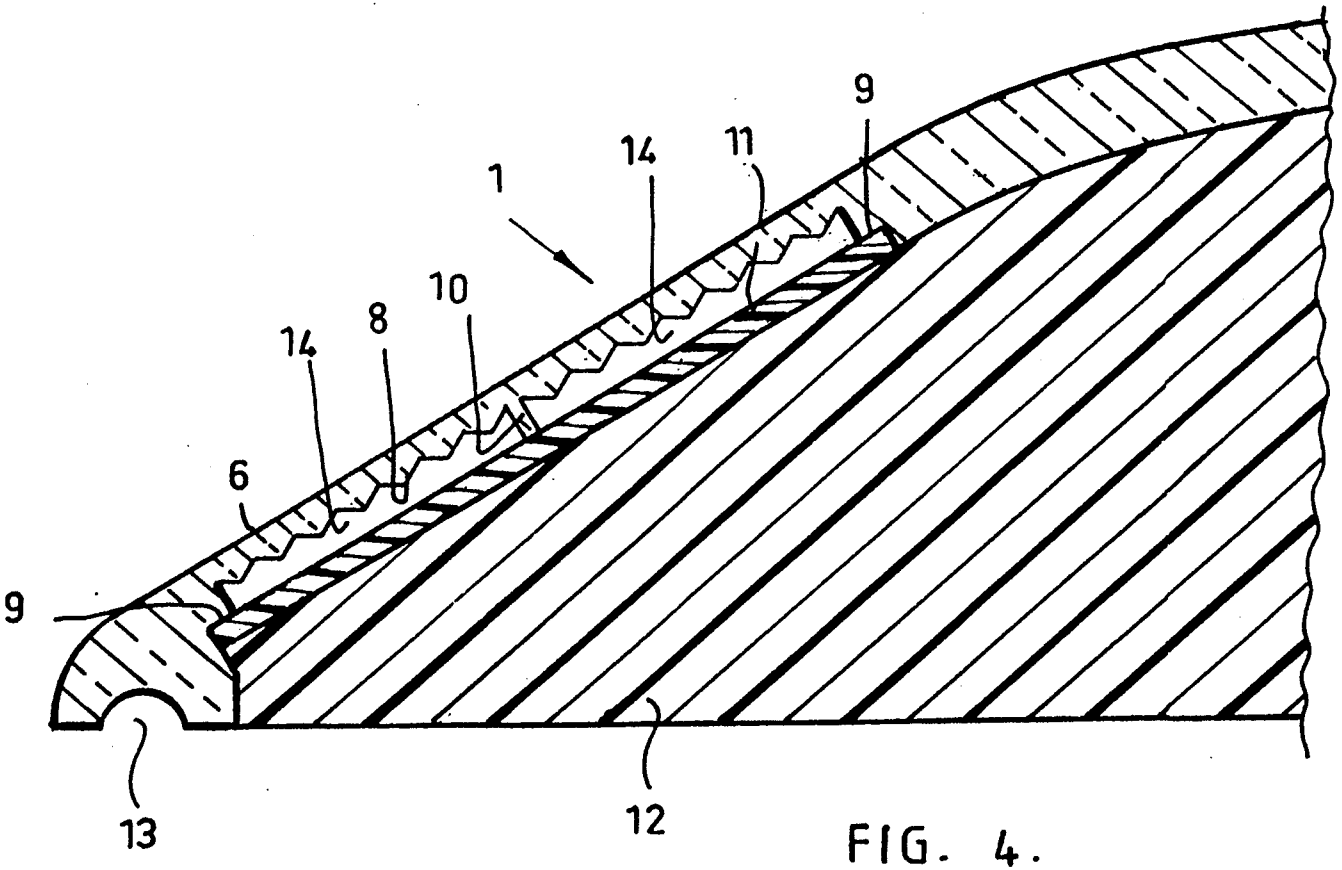
FIG. 4 is fragmentary sectional elevation.

The enlarged fragmentary sectional elevation, FIG. 4, illustrates the cross-sectional configuration of the shell. It will be seen in FIG. 4 how the shell wall thickness is reduced behind the face 6 to form a recess which is defined by a land 9. In the several views of the marker the numeral 10 indicates walls that divide the prism covered surface into areas. The free upper edges of the walls 10 and the lands 9 are substantially co-planar.

FIG. 4 also illustrates a backing plate 11 which is fused to the upper edges of the walls 10 and the lands 9 to create several hermetic chambers 14 with the crests of the prisms 8 spaced from the backing plate 11. The bonding can be effected in several ways, for example, by glueing or by sonic welding.

The numeral 12 indicates a filling medium, such as epoxy resin, to occupy the hollow underface of the shell and provide a base for the marker. It is to be understood that the filling medium is not restricted to an epoxy resin and almost any thermosetting material could be used.

The plan view of the proposed marker approximates a circle. The base shape of known markers is usually rectangular with the shorter of the length or breadth dimension approximating the diameter of the proposed marker. It follows therefore that less glue is required to cover the base of the marker of this invention than is required for full coverage of the rectangular base of the markers now in common use. Where many thousands of markers are to be glued in place this represents a substantial saving in cost.

In addition, experimentation has shown that a substantially circular marker is simpler to securely fix to a pavement than a rectangular marker. In experiments a glue dab generally centrally placed on a circular form of marker can be uniformly distributed over the whole of the circular marker base by the application of downward and part-circular motions as the marker is applied to a pavement. If such a simple application technique is used on rectangular based markers there is almost invariably a deficiency of glue at the corners of that marker base.

The foregoing has considerable relevance to the lifespan of road markers. It has been found that corners on markers, as exist with rectangular base markers, present zones where force concentrations occur when a vehicle wheel passes over the marker the corners of rectangular markers are often unsupported or poorly supported by glue because of inefficient fixing techniques. The lack of glue support is believed to lead to flexure of the marker corners when under load (due for example to a vehicle tire passing thereover) and a tendency for such markers to lose adhesion at the corners. Constant wheel impact leads to progressive adhesion loss under the above circumstances and the marker becomes loose. With the proposed generally circular marker the glue support tends to be substantially uniform over the entire base of the marker thereby avoiding the flexure possibility outlined above.

The semi-domed body shape adopted for the present marker is intended to provide better distribution of the force concentrations which are developed by the passage of a vehicle wheel over the marker. The force concentrations on rectilinearly shaped markers as a vehicle wheel passes thereover tend to less uniformly distributed than is the case with the shape proposed for the present marker. For this reason also, it is expected that the in-situ operational life of the proposed marker will substantially exceed that of known markers.

To facilitate anchorage of the marker it is proposed to provide a cut away zonal portion 13 at the junction of the shell wall and the filling material 12. A glue bead will form in the zone 13 around the underface of the marker body and on hardening the glue will provide a ridge of glue in shear to resist marker loosening impact from vehicle wheels.

It is to be understood that a marker as proposed could be made with one, or more than two reflective panels.

Whilst all of the foregoing are important aspects of the present invention the provision of a reflector panel backed by a hermetic chamber constitutes the most important departure from known pavement marker construction. Preferably there is a number of chambers behind each reflector panel. Experience with traditional constructions using corner cube reflectors in raised single shell pavement markers (without or without metalising of the prismatic surface) and backfill, shows that a fracture of the marker which allows moisture and dirt to enter the marker will result in a rapid deterioration in the reflectivity of the marker.

The structure of the present marker in a multi-chamber form creates a number of segregated sealed chambers each of which has an associated reflector panel. In the unlikely event a fracture does occur in the marker it is very unlikely that more than one chamber will lose its integrity and any loss or performance of the reflector of that chamber will reduce the performance by only a fraction of the whole. In the illustrated example the loss would be one eighth of the whole. Accordingly, the operational life of the marker of this invention can be confidently expected to be several times that of known markers.

Another aspect of the present marker is that experimentation has shown that unmetalised corner cube reflective surfaces have greater reflectivity than metalised surfaces. In practice metalising is relied upon in known hollow shell markers to separate the corner cube surface from the back fill material of such markers, with which it comes in direct contact. As the present construction uses a backing plate to separate the corner cube surface from the back fill material the metalising is not required and accordingly the reflectivity of the presently proposed marker per unit of area is greater than that of a corresponding area of metalised reflector.

The foregoing is a presently preferred form of the invention and it is to be understood that features of described embodiment can be altered without departing from the inventive concept disclosed. By way of example, the reflectors need not be of the corner cube form.

I claim:

1. A pavement marker, comprising:

a base surface;

a saucer-like shell body made of plastic material and having an integral light-transparent wall zone with a substantially flat outer surface of said light-transparent wall zone lying in a plane at an acute angle to said base surface;

shoulder means bordering an inner face of said light-transparent wall zone;

ribs upstanding from said inner face of said light-transparent wall zone for dividing said inner face of said light-transparent wall zone into separated areas and intersecting with said shoulder means, said ribs having upper edges;

a continuous bonding path comprising said shoulder means and said upper edges of said ribs;

uncoated reflective prismatic projections upstanding from a surface of said separated areas and terminating at an elevation below the elevation of said bonding path;

a backing plate sealing bonded to said continuous bonding path for providing hermetically sealed chambers with each containing said prismatic projections spaced from said backing plate; and, an infill material bearing against said backing plate and filling said saucer-like shell and forming said base surface for said pavement marker.

2. The pavement marker according to claim 1, wherein said prismatic projections are corner cube reflectors.

3. The pavement marker according to claim 1, wherein said saucer-like shell body has a convexly-curved outer surface except for said flat outer surface of said light-transparent wall zone which as substantially straight upper edges and lower edges and end edges which are curved in conformity with the curvature of said convexly-curved outer surface.

4. The pavement marker according to claim 3, further comprising a peripheral base edge comprised of curves and a substantially straight portion immediately below said light-transparent wall zone.

5. The pavement marker according to claim 1, wherein said infill material is a thermo-setting material.

6. The pavement marker according to claim 5, wherein said thermo-setting material is an epoxy resin.

7. The pavement marker according to claim 1, wherein said base surface includes adhesive anchoring means in the form of recesses in said base surface.

8. The pavement marker according to claim 1, comprising a plurality of said light-transparent wall zones having uncoated reflective prismatic projections upstanding from areas of inner surfaces of said light-transparent wall zones wherein said prismatic projections lie within hermetically sealed chambers.

* * * * *